US008475163B2

(12) United States Patent
Schwank et al.

(10) Patent No.: US 8,475,163 B2
(45) Date of Patent: Jul. 2, 2013

(54) HEATING DEVICE AND METHOD FOR ITS OPERATIONS

(75) Inventors: Bernd H. Schwank, Köln (DE); Konrad Weber, Burscheid (DE)

(73) Assignee: Schwank GmbH, Köln (DE)

( * ) Notice: Subject to any disclaimer, the term of this patent is extended or adjusted under 35 U.S.C. 154(b) by 143 days.

(21) Appl. No.: 11/637,620

(22) Filed: Dec. 12, 2006

(65) Prior Publication Data

US 2007/0221196 A1 Sep. 27, 2007

(30) Foreign Application Priority Data

Dec. 13, 2005 (EP) ..... 05027165

(51) Int. Cl.
*F23C 9/00* (2006.01)
*F24D 5/04* (2006.01)

(52) U.S. Cl.
USPC ..... 431/115; 237/53

(58) Field of Classification Search
USPC ..... 431/115; 237/53; 432/147, 31
See application file for complete search history.

(56) References Cited

U.S. PATENT DOCUMENTS

| | | | | | |
|---|---|---|---|---|---|
| 3,307,529 | A | * | 3/1967 | Fannon, Jr. et al. | 126/92 B |
| 3,399,833 | A | | 9/1968 | Johnson | |
| 3,741,710 | A | * | 6/1973 | Nelson | 431/90 |
| 3,907,488 | A | * | 9/1975 | Takahashi et al. | 431/2 |
| 4,390,125 | A | * | 6/1983 | Rozzi | 237/70 |
| 4,673,348 | A | * | 6/1987 | Riley et al. | 431/115 |
| 4,800,866 | A | | 1/1989 | Finke | |
| 4,856,492 | A | * | 8/1989 | Kawamoto | 126/91 A |
| 4,870,947 | A | * | 10/1989 | Kawamoto | 126/91 A |
| 4,995,807 | A | * | 2/1991 | Rampley et al. | 431/9 |
| 5,000,158 | A | * | 3/1991 | Watson et al. | 126/91 A |
| 5,211,331 | A | * | 5/1993 | Seel | 236/15 C |
| 5,273,210 | A | * | 12/1993 | Pender et al. | 237/53 |
| 5,304,059 | A | * | 4/1994 | Tanaka et al. | 431/170 |
| 5,388,985 | A | * | 2/1995 | Musil et al. | 431/116 |
| 5,429,112 | A | * | 7/1995 | Rozzi | 126/116 A |
| 5,431,147 | A | * | 7/1995 | Tanaka et al. | 431/170 |
| 5,560,350 | A | * | 10/1996 | Kim | 126/113 |

(Continued)

FOREIGN PATENT DOCUMENTS

| | | |
|---|---|---|
| DE | 3814897 A1 | 11/1989 |
| DE | 9207435 U1 | 6/1991 |
| DE | 4430860 A1 | 3/1996 |
| EP | 0282838 A1 | 9/1988 |

*Primary Examiner* — Steven B McAllister
*Assistant Examiner* — Frances H Kamps

(57) ABSTRACT

This invention relates to a heating device consisting of at least one burner for the combustion especially of a gaseous fuel, at least one radiant tube connecting to the burner, at least one fan generating a negative pressure or an excess pressure in the radiant tube, and at least one exhaust gas recirculation system with at least one exhaust gas recirculation passage through which an exhaust gas produced during the combustion of the primary fuel can be recirculated from the radiant tube to a transition zone from the burner into the radiant tube. In order to further develop a heating device of this type as well as a method for its operation the burner is adapted for being operated in at least two power stages and the exhaust gas recirculation system is controlled in dependence of the power stages of the burner in such a way that the volume flow of the recirculated exhaust gas is reduced with an increasing power stage of the burner.

30 Claims, 5 Drawing Sheets

Figure 1:
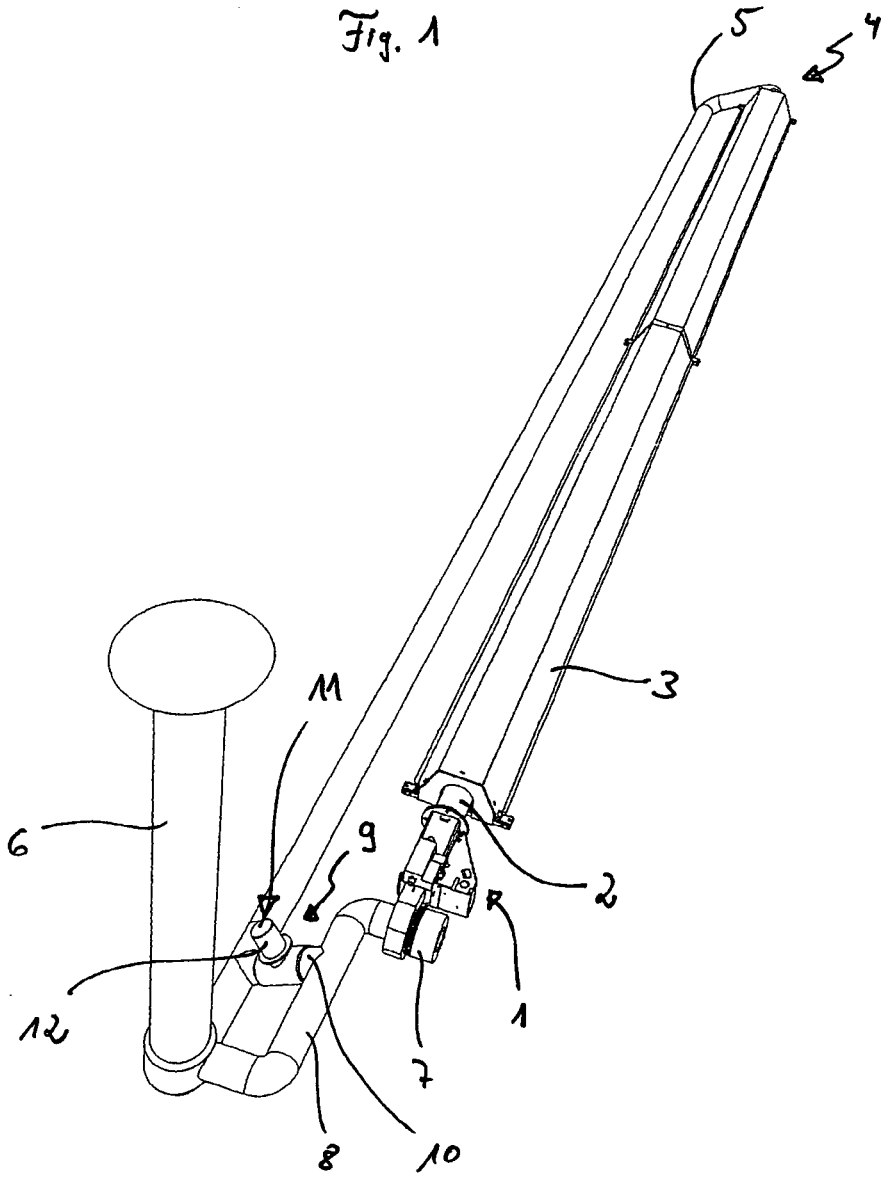

U.S. PATENT DOCUMENTS 5,586,877 A * 12/1996 Charmes ..... 431/115
5,616,021 A * 4/1997 Onimaru et al. ..... 431/115
5,628,303 A * 5/1997 Ahmady et al. ..... 126/91 A
6,027,333 A * 2/2000 Fujii et al. ..... 431/215
6,190,159 B1 * 2/2001 Moore et al. ..... 431/11
6,217,320 B1 * 4/2001 Eaves ..... 432/209
RE37,636 E * 4/2002 Wortman et al. ..... 237/2 R
6,481,434 B2 * 11/2002 Murdoch ..... 126/91 A
6,776,609 B1 * 8/2004 Sullivan et al. ..... 431/9
6,786,422 B1 * 9/2004 Wortman et al. ..... 237/70
6,971,871 B2 * 12/2005 Ahmady ..... 431/180
7,074,033 B2 * 7/2006 Neary ..... 431/5
7,104,787 B2 * 9/2006 Collier ..... 431/215
7,196,263 B2 * 3/2007 Fraas et al. ..... 136/253
2005/0175944 A1 * 8/2005 Ahmady ..... 431/18
2005/0247300 A1 * 11/2005 Collier ..... 126/91 A
2005/0266362 A1 * 12/2005 Stone et al. ..... 431/18
2006/0169275 A1 * 8/2006 Murdoch ..... 126/91 A
2007/0037104 A1 * 2/2007 Musa et al. ..... 431/5
2007/0054227 A1 * 3/2007 Tada et al. ..... 431/181
2007/0084855 A1 * 4/2007 Oberhomburg ..... 219/497

* cited by examiner

HEATING DEVICE AND METHOD FOR ITS OPERATIONS

This invention relates to a heating device which consists of at least one burner for the combustion especially of a gaseous fuel, at least one radiant tube connecting to the burner, at least one fan which generates a negative pressure or an excess pressure within said radiant tube, and at least one exhaust gas recirculation system which includes at least one exhaust gas recirculation passage through which exhaust gas that is produced during the combustion of the primary fuel can be recirculated from the radiant tube to a transition zone from the burner into the radiant tube. The invention further relates to a method for the operation of a heating device, in which method especially a gaseous fuel is burnt in at least one burner and a flame which heats up the radiant tube is produced in at least one radiant tube connecting to the burner, and a negative pressure or an excess pressure are generated through a fan in said at least one radiant tube, and exhaust gas which is produced during the combustion of the fuel is recirculated through at least one exhaust gas recirculation system including at least one exhaust gas recirculation passage from the radiant tube to a transition zone from the burner into the radiant tube.

Heating devices having a construction as described above and among others also referred to as dark radiators are heat generators which are operated with gaseous or liquid fuels and are preferably used for heating bigger rooms like industrial halls or factories. These heating devices normally consist of a radiant tube to which a burner and a fan are connected. The fan can be arranged on the input side of the burner, so that the fan works as a pressure-type fan. Alternatively, the fan can be arranged on the output side of the radiant tube, the output side of the radiant tube being the end of the radiant tube which is directed away from the burner. In this alternative the fan works as an extraction fan sucking off the exhaust gases that are introduced in the radiant tube during the combustion of the gaseous or liquid fuels.

The radiant tube can be formed in a linear or curved shape or with one or several knees and can consist of several segments, and the radiant tube normally includes a reflector housing which directs heat to be radiated from the radiant tube in a predetermined direction. At the normal use of a heating device of the kind described, where the heating device is installed under the ceiling of a building, the reflector housing is arranged on an upper side of the radiant tube so as to be facing the ceiling, in order to direct radiation heat specifically to a lower part of a room, for instance to the zone where people, animals and/or plants are.

In a heating device of the kind described above and to be referred to as a dark radiator the transfer of heat to a room to be heated takes place primarily through infrared radiation. During its operation the burner produces inside the radiant tube a long flame which may be several meters long, depending on the fuel and load. The exhaust gases produced during the combustion are conveyed by the fan through the radiant tube and are finally supplied to an exhaust passage which is normally connected to the end of the radiant tube which is directed away from the burner. Through the exhaust passage exhaust gases are removed from an upper part of the building close to the ceiling directly or indirectly together with the aeration of the room.

By a special formation of the flame a temperature distribution as uniform as possible is obtained over the longitudinal axis of the radiant tube. The radiant tube which is heated through the flame and through the heat of the exhaust gases emits a heat radiation of a particular wave length range which as electromagnetic waves penetrates the room almost lossfree and is converted in sensible heat only after meeting against absorbing surfaces like parts of a building, for instance walls and floors, pieces of furniture, human beings, animals, plants. For this reason, a heating device of this type in the form of a dark radiator works particularly energy-saving in big rooms.

From the document DE 44 30 860 A1 there is known for example a heating device which is formed as a radiant element and which includes a gas-fired burner, a radiant tube connected to it and an extraction fan in a housing. The radiant tube is formed as a closed tube system and has a U-shaped configuration. The extraction fan generates within the housing a negative pressure which is intended for producing a flame that passes through the interior of the radiant tube smoothly and uniformly and enables the removal of the exhaust gases.

Furthermore, the document EP 0 282 838 B1 discloses a gas-fired heating radiator including a radiant tube as a combustion space and including a burner which is connected to one end of the radiant tube. On the opposite end of the radiant tube a fan is connected sucking exhaust gases off the radiant tube. The radiant tube is U-Shaped and is arranged in a housing.

A further heating device is known from the document DE 91 03 004 U1 which includes a radiant tube that is connected to a pressure and mixing chamber housing. On one side the radiant tube is connected to a backflow chamber with a fan and on the other side to a mixing chamber with a flame tube surrounding a burner. The pressure and mixing chamber housing has a twin-screw shape, with two cylinder-like parts forming the housing and with a front and a back plate having the twin-screw shape. Between the backflow chamber and the mixing chamber a flap is arranged, of which the position can be regulated. By means of this flap the amount of air and the pressure ratios are adjusted for the different lengths of the radiant tube. The fan includes an impeller with adjustable speed, in order to adjust the volume flow of the sucked-off waste gases for different lengths of the radiant tube. Accordingly, this pre-known heating device can be readily adapted to differently long radiant tubes without requiring structural modifications of the heat generating elements such as the burner.

A gas-fired heating device of the type as described above is further known from the document DE 92 07 513 U1 and includes a U-shaped radiant tube having arranged an upstream burner on its part on the inflow side and having arranged an extraction fan on its part on the outflow side. On its outflow side the extraction fan includes a bypass passage which is connected to the radiant tube on the inflow side and through which a part of the exhaust gases is introduced in the inflow-side part of the radiant tube, with a flame being produced by the burner in the inflow-side part of the radiant tube. In this heating device it is provided that 15 to 30% by volume of the exhaust gases are passed via the bypass passage and that the bypass passage can be throttled, in order to adjust the amount of exhaust gases so as to suit the construction of the heating device, particularly the length of the radiant tube, so that differently designed heating devices and particularly heating devices with a variable length of the radiant tube can be formed and operated with the required efficiency, independently of the burner.

Heating devices of the above-described construction are predominantly operated in an ON/OFF mode, in which the burner is either switched on or switched off, so that either a preset power or no power is delivered. The operation of this heating device is particularly determined by the heat distribution provided in the room to be heated and by the pollutant concentration of the exhaust gases.

Since normally the heating device is set for the maximum heat consumption of the room to be heated at lowest outside temperatures, the result is an intermittent operation of the heating device at temperature variations during an annual heating period. The consequences are less convenience due to fluctuations in the room temperature and as a result energy losses of the building which as a rule have to be compensated by an expensive insulation. Due to the intermittent operation with frequent warming up and cooling down processes the heating device and its components are subject to a relatively high load and accordingly to an increased wear of its components.

Because of the narrow physical limits it is not easily possible to make an adaptive control of the power output by a multi-step or continuously modulated operation of the heating device. If for instance the gas load is reduced without adapting/adjusting the blower output, the amounts of excess air will be too high, accompanied by a tendency of higher exhaust gas losses of the heating device. Also, the flame length will be considerably reduced at a high amount of excess air, resulting in a reduced heat distribution within the radiant tube and accordingly in a less favourable distribution of radiation in the room to be heated.

If on the other hand the blower output is reduced with the gas load, the large heat transfer areas and the high heat capacities of the heating device will result in an undesired condensation. In addition, the construction of the required air deficiency safety device is more complicated.

Starting from the above-described prior art and the drawbacks involved in this prior art, the invention is based on the problem of further developing a heating device of the described type as well as a method for its operation to an extent that an adaptation of the power output of the heating device is possible with a simple construction and without the aforementioned drawbacks, while obtaining in each power range an optimum heat distribution at small losses of exhaust gas and consequently a high thermal comfort in rooms to be heated, with small energy losses and with clearly reduced pollutant concentrations of the exhaust gases and at the same time avoiding condensation effects, so that the service life of the heating device according to the invention is clearly increased.

In a heating device according to the invention the solution of this problem is obtained by the burner being adapted for operation in at least two power stages and by the exhaust gas recirculation system being adapted to be controlled in dependence of the power stages of the burner in such a way that the volume flow of the recirculated exhaust gas is reduced with an increasing power stage of the burner.

On part of the method according to the invention for operating a heating device it is provided as a solution that the burner is operated in at least two power stages and that the exhaust gas recirculation system is controlled in dependence of the power stages of the burner in such a way that the volume flow of the recirculated exhaust gas is reduced with an increasing power stage of the burner.

Further features and advantages of the invention will become apparent from the dependent claims and from the following description of embodiments and further developments of the heating device and the method according to the invention.

Accordingly, in the heating device according to the invention it is provided that at the same time as the power output is reduced by reducing the gas load a part of the exhaust gas is introduced in the fresh air which is taken in or in the radiant tube subsequent to the burner and recirculates in the radiant tube. The volume flow of the recirculated exhaust gases can be regulated for instance by means of a control element which is formed as a volume flow regulator which is provided in an exhaust gas recirculation system between a fresh air passage with a normally low pressure level and an exhaust gas passage with a normally higher pressure level that is arranged on the end of the radiant tube directed away from the burner. The control element can be driven for instance electrically and simultaneously with a signal for reducing the power output of the burner. Therefore, any additional driving means for conveying the recirculated exhaust gas is not necessarily required.

In a preferred embodiment of the invention the fan is arranged on the input side of the burner, so that both the fresh air required for the combustion and recirculating exhaust gases are forced into the burner and hence into the downstream radiant tube. On the input side of the fan an intake passage is arranged for the intake of fresh air from the room or from outside via a passage through the roof. In the intake passage a small negative pressure exists compared to the atmosphere.

The exhaust passage which is arranged on the end of the radiant tube serves to discharge exhaust gases for instance through the roof of the building to be heated. In this exhaust passage a small excess pressure exists as compared to the atmosphere. Between the intake passage and the exhaust passage a short temperature-resistant connecting passage is arranged which includes as a control element for instance an exhaust gas flap that is driven by an electric motor and that is thermally controlled for example.

The gas-operated burner includes in the preferred embodiment a two or multi-step magnetic valve for fuel supply, the steps of the valve being selected by a room temperature regulator in dependence of the required heat.

In a high power stage of the heating device an elongate flame is produced by the burner in the radiant tube which leads to a favourable heat distribution. In this power stage no exhaust gas or only a small amount of exhaust gas, for example 0 to 30% by volume of the available exhaust gas are recirculated to the radiant tube through the exhaust gas recirculation system for instance via the fresh air passage of the burner. Due to the special flame formation, the emission of nitrogen oxides which are thermally produced during the combustion and which are harmful to the environment is determined in this condition by the flame length (sojourn time) and flame temperature. The flame temperature necessarily is relatively high, in order to produce a high temperature in the radiant tube.

In a lower power stage a larger volume flow of the exhaust gases, for instance 20 to 60% by volume of the available exhaust gas are recirculated to the radiant tube for example via the fresh air passage of the burner and are mixed with fresh air in the fan and are supplied to the burner and/or radiant tube, by opening the volume flow regulator, for example the exhaust gas flap in the exhaust gas recirculation system. Without adding the exhaust gases the flame length in the low power stage would be drastically reduced due to the high amount of excess air, so that in the radiant tube the heat distribution would become worse and higher exhaust gas losses would be produced. By the output-related exhaust gas recirculation according to the present invention the flame is extended at a reduced flame temperature and a very favourable heat distribution is attained at a reduced radiation power due to the locally smaller amount of oxygen offered, through the addition of exhaust gas.

Further, by the exhaust gas recirculation in the lower power stage the exhaust gas losses of the burner are kept constant and are even further reduced compared to the higher power stage. A further advantage of the invention is that the amount of exhausted nitrogen oxides of the burner is clearly reduced in the lower power stage due to the reduced combustion temperature and the low oxygen partial pressure in the flame. It is possible to reduce the amount of the contaminant transport over a whole heating period up to 50%, depending on the exhaust gas addition rate.

Besides the above-described operation of the burner in two power stages it is also possible to operate the burner in a modulating fashion in power stages. Accordingly, the possibility exists that the burner output is continuously varied, and at the same time the recirculating exhaust gas is supplied to the radiant tube corresponding to the power stage, while simultaneously effecting in turn a control of the burner and the exhaust gas recirculation system.

The exhaust gas recirculation system preferably includes a volume flow regulator for the volume flow of the recirculated exhaust gas. The volume flow regulator can be formed for instance as a bypass valve which is inserted in an exhaust gas recirculation passage and which can be controlled with regard to its opening. It is also possible for the volume flow regulator to control the output and particularly the speed of the fan, so that for example by increasing the speed of the fan a larger volume flow of exhaust gas is taken in and supplied to the radiant tube. A further alternative provides that that volume flow regulator includes a flap and/or sliding valve which is arranged in the exhaust gas recirculation passage and which closes when a certain output of the burner is reached. The above-mentioned volume flow regulators can be provided also in a combination, and a combination of a speed regulation of the fan and a volume flow regulation system in the form of a bypass valve or a flap and/or a sliding valve turned out to be advantageous.

As far as the burner has two power stages, it turned out to be advantageous that the exhaust gas recirculation system is activated in one power stage and is deactivated in a further power stage. As a rule, the exhaust gas recirculation system is deactivated in the higher one of the two power stages of the burner, while it is activated in the lower one of the two power stages of the burner, in order to return a predetermined volume flow of exhaust gas to the radiant tube.

As it has been already discussed above, the fan can be arranged both on an end of the radiant tube opposite to the burner or together with the burner on one end of the radiant tube. If the fan is arranged on an end of the radiant tube opposite the burner, the fan generates a negative pressure in the radiant tube, so that the exhaust gases are sucked off and are in case supplied again to the radiant tube in the region of the end of the radiant tube including the burner. If the fan together with the burner is arranged on one end of the radiant tube, the fan generates an excess pressure in the region of the radiant tube, in which case the fan is provided both for supplying fresh air and for supplying the exhaust gas to be recirculated. Of course, it is also possible to form the heating device according to the invention with two fans, provided that the radiant tubes have a corresponding length, one fan being arranged on an end of the radiant tube opposite the burner and one fan together with the burner being arranged on one end of the radiant tube.

In a preferred embodiment of the invention it is provided that at least two radiant tubes are arranged oppositely to each other, each of which having a burner, and that each of the radiant tubes has an exhaust gas recirculation system through which the exhaust gases are introduced in the respective oppositely arranged radiant tube. In this embodiment of the invention the radiant tubes are normally formed in a linear fashion, and the two burners are arranged on diametrically opposite ends of the radiant tubes, so that the free end of the first radiant tube is arranged in the region of that end of the second radiant tube to which the burner is mounted in the second radiant tube. On the end of the first radiant tube the exhaust gas recirculation system of the first radiant tube is arranged, through which the exhaust gas produced by the burner of the first radiant tube is introduced in the region between the burner and the second radiant tube. This also applies for the end of the second radiant tube which is arranged in the region of the first radiant tube including the burner and which also has an exhaust gas recirculation system through which the exhaust gas of the second radiant tube is introduced in the first radiant tube, in the region between the burner and the first radiant tube.

Normally, this embodiment of a heating device is able to operate also without an output-related introduction of the exhaust gases in the corresponding radiant tubes. But it turned out that also with this construction of the heating device an output-related recirculation of the exhaust gases is advantageous.

A further development of this heating device provides that the radiant tubes are oriented in a mutually parallel extending fashion. Preferably, the two radiant tubes are arranged in a common housing, so that both radiant tubes directionally convey the thermal energy to the room to be heated through a common reflector. Of course, it is also possible to arrange the two mutually parallel aligned radiant tubes in different housings, each of which having a reflector, and the reflectors can have different orientations, to make it possible for the two radiant tubes to convey heat selectively to different areas.

A further form of this advantageous embodiment of the heating device according to the invention provides that the exhaust gas recirculation systems are controllable in dependence of the output of the burner of the oppositely directed radiant tube. Preferably, a further development provides that the exhaust gas recirculation devices of the mutually oppositely directed radiant tubes are controllable independently of each other.

According to a further feature of the invention it is provided that the exhaust gas recirculation system includes a measuring element, by means of which parameters like temperature, exhaust gas values, volume flow or the like are measured and used for the control of the exhaust gas recirculation system. If for instance an inadmissible exhaust gas value is measured by such a measuring element, the exhaust gas recirculation systems can be influenced for a short time independently of the power stage, in order to bring the required parameters like temperature, exhaust gas values, volume flow or the like to the preset range which enables an optimum operation of the heating device according to the invention.

A further development of the heating device according to the invention provides that the volume flow regulator can be driven electrically and/or thermally. An electrical drive of the volume flow regulator results in a simple construction of the exhaust gas recirculation system and enables the simultaneous selection of the power stages of the burner and the exhaust gas recirculation system. In addition to a thermal switching element time-delayed circuits can be provided which are triggered only upon reaching a predetermined temperature in the exhaust gas flow or in the radiant tube. Preferably, the volume flow regulator can be driven simultaneously with an output regulator of the burner.

The above-described advantages of the heating device according to the invention substantially apply also for the method according to the invention, so that concerning the embodiment of the method according to the invention reference may be made to the above-described advantages of the heating device according to the invention.

Figure 2:
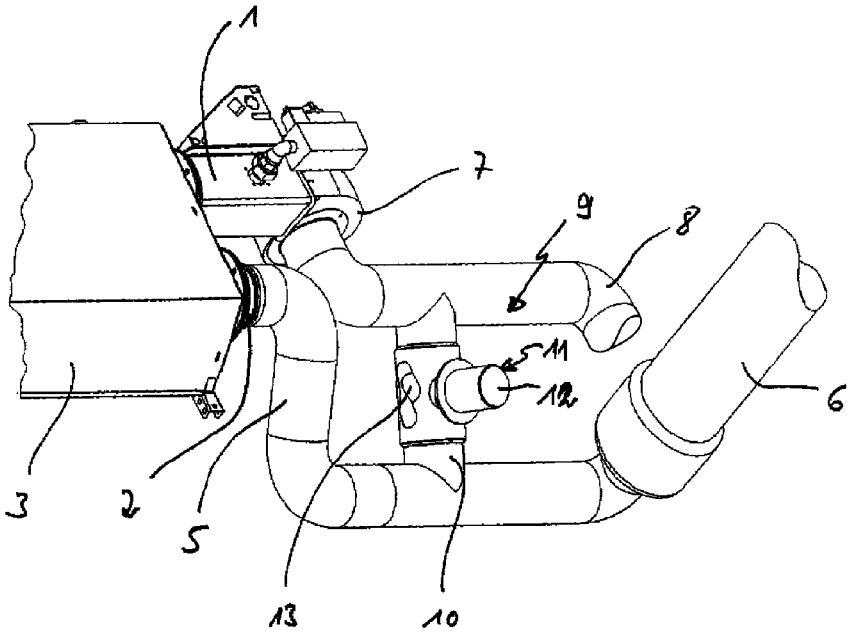
Figure 3:
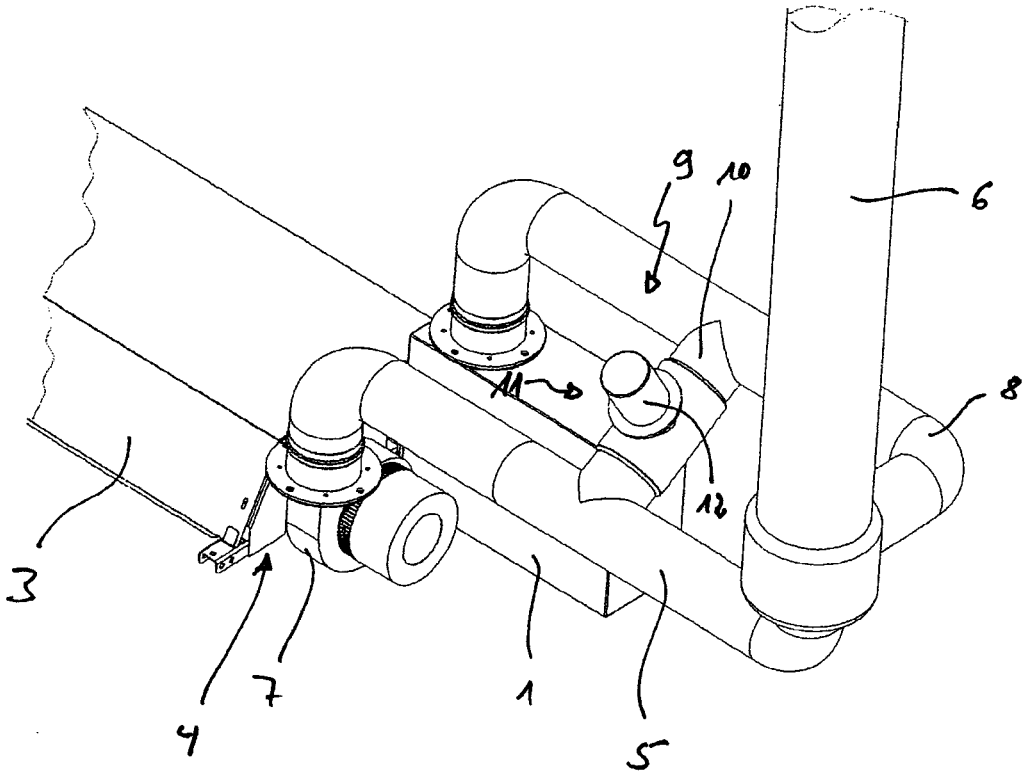
Figure 4:
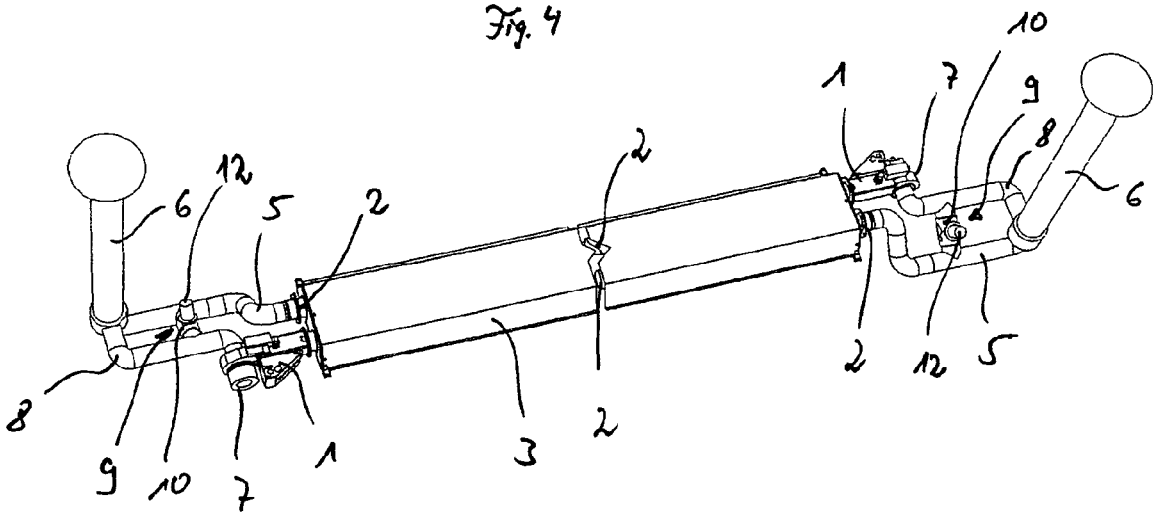
Figure 5:
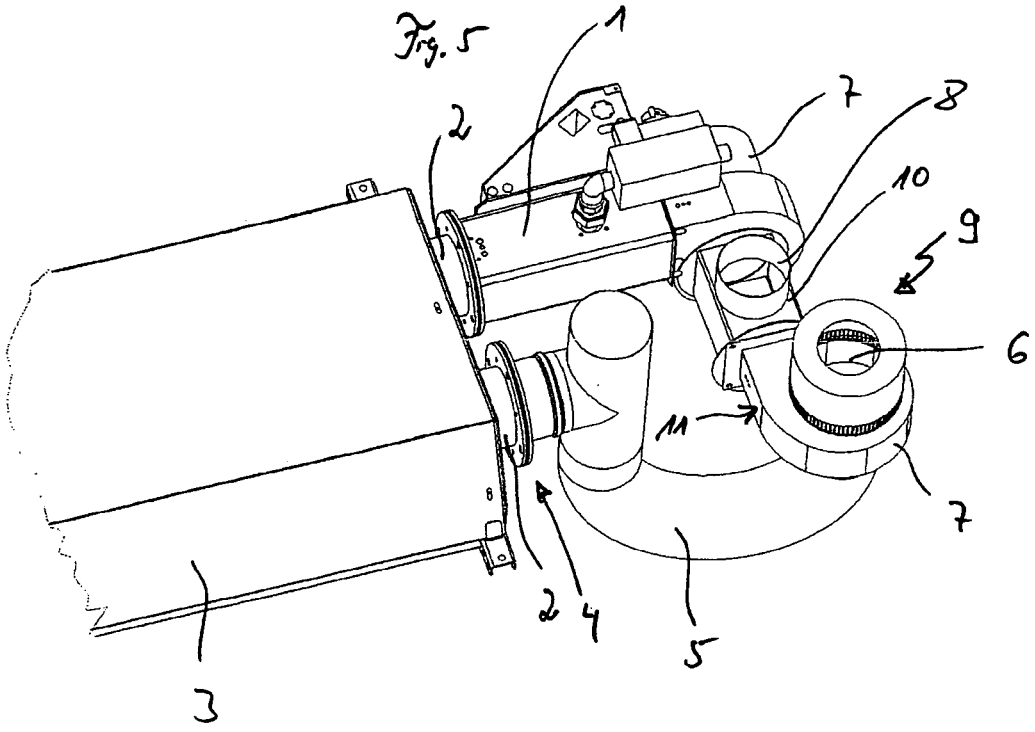

Further features and advantages of the invention will become apparent from the following description of the attached drawings showing a preferred embodiment of the heating device according to the invention. In the drawings it is shown by:

FIG. 1 a perspective view of a first embodiment of a heating device;

FIG. 2 a perspective view of a part of a second embodiment of the heating device;

FIG. 3 a perspective view of a part of a third embodiment of a heating device;

FIG. 4 a perspective view of a fourth embodiment of a heating device;

FIG. 5 a perspective view of a fifth embodiment of a heating device; and

Figure 6:
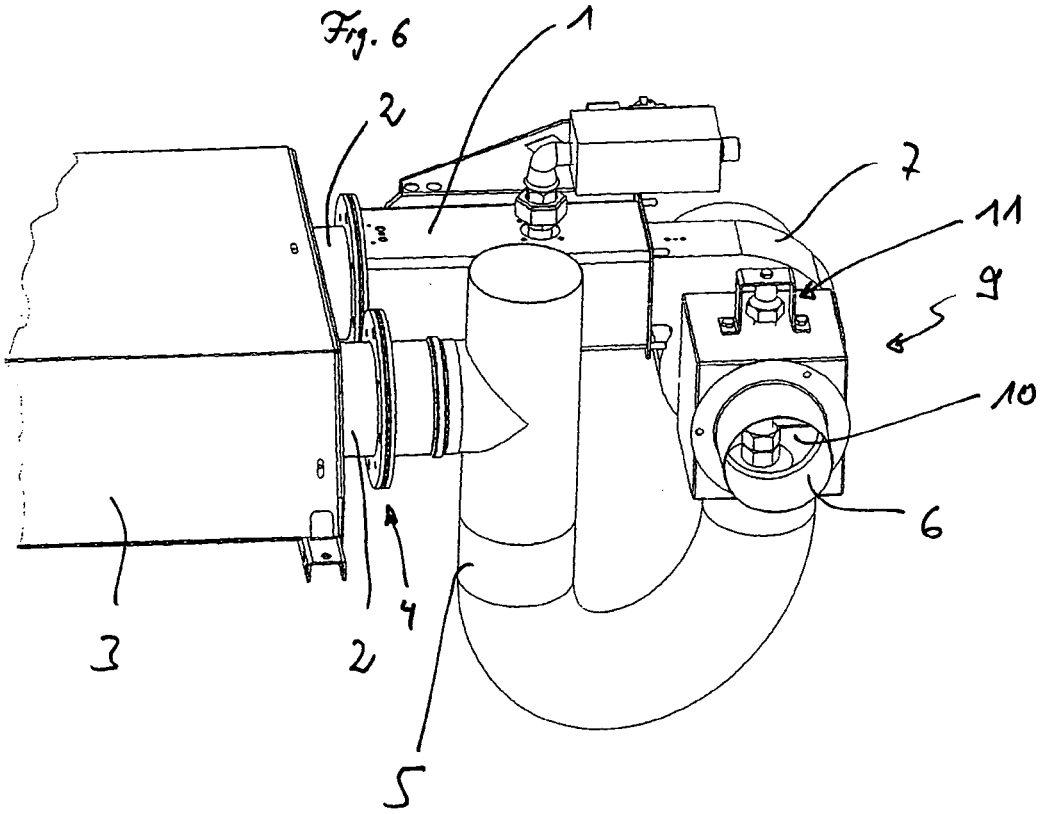

FIG. 6 a perspective view of a sixth embodiment of a heating device.

In FIG. 1 a first embodiment of a heating device is shown in a perspective view. The heating device consists of a burner 1 for the combustion especially of a gaseous fuel. The burner 1 is flanged on its end to a radiant tube 2 and produces a flame within the radiant tube 2 during the combustion of the fuel, which flame extends into the radiant tube 2. The linear radiant tube 2 is arranged in a housing 3 which has a trapezoidal cross section and which includes an opening through which heat radiation produced by the radiant tube 2 can exit. On its inner surface (not further shown) the housing 3 includes a reflector which supports the dissipation of heat radiation.

On its second end 4 arranged oppositely to the burner 1 the radiant tube 2 includes an exhaust passage 5 which runs parallel to the radiant tube 2 outside 110 the housing and which opens into a chimney 6 through which the exhaust gas produced during the combustion of the fuel is discharged.

The burner 1 has an upstream fan 7 which is formed as a radial fan in the illustrated embodiment. Through the fan 7 fresh air for the combustion in the radiant tube 2 is drawn into the radiant tube 2 by the burner 1, and the fan 7 is connected to a fresh air passage 8.

Between the exhaust passage 5 and the fresh air passage 8 an exhaust gas recirculation system 9 is arranged which consists of an exhaust gas recirculation passage 10 and a volume flow regulator 11.

The volume flow regulator 11 includes an electric motor 12 through which a flap (not further shown) can be moved that is arranged in the exhaust gas recirculation passage 10.

In the embodiment of the heating device illustrated in FIG. 1 the burner 1 can be operated in two power stages, and the exhaust gas recirculation system 9 can be controlled in dependence of the selected power stage of the burner 1. The flap (not further shown) which is arranged in the exhaust gas recirculation system 9 is closed during the operation of the burner 1 in the higher one of the two power stages, so that the exhaust gas carried via the exhaust gas passage 5 is completely discharged through the chimney 6. If the burner 1 is switched to the lower one of the power stages, the flap (not further shown) which is arranged in the exhaust gas passage 10 is pivoted by the electric motor 12, so that a part of the exhaust gas from the exhaust gas passage 5 is admixed to the fresh air in the fresh air passage 8 through the exhaust gas recirculation passage 10 and is blown into the burner 1 and the radiant tube 2 through the fan 7.

In FIG. 2 a second embodiment of a heating device is illustrated which substantially corresponds to the embodiment according to FIG. 1, so that identical parts carry identical reference numbers. Differently from the embodiment according to FIG. 1 the heating device according to FIG. 2 includes a U-shaped radiant tube 2 having two mutually parallel extending tube portions within the housing 3 which are interconnected by a U-shaped connecting element. Consequently, in the embodiment according to FIG. 2 also the residual heat of the exhaust gas within the radiant tube 2 is utilized, and the exhaust passage 5 is formed much shorter compared to the embodiment according to FIG. 1.

Moreover, FIG. 2 shows the flap 13 which has been explained in conjunction with the embodiment according to FIG. 1 but has not been further illustrated there. The flap 13 is arranged in the exhaust gas recirculation passage 10 and can be driven through the electric motor 12.

A third embodiment of a heating device is illustrated in FIG. 3. This embodiment substantially corresponds to the embodiment according to FIG. 2, so that here, too identical reference numbers are used for identical components.

The difference between the embodiments according to the FIGS. 2 and 3 resides in the fan 7 being arranged upstream of the burner 1 in the embodiment according to FIG. 2, so that the fan forces the fresh air and in case the recirculated exhaust gas into the burner 1 and the radiant tube 2, whereas the fan 7 of the embodiment according to FIG. 3 is arranged on the end 4 of the radiant tube 2, so that a negative pressure is produced in the radiant tube 2 through the fan 7.

In FIG. 4 a fourth embodiment of a heating device is shown which differently form the embodiments of the heating device shown in the FIGS. 1 to 3 includes two mutually parallel extending radiant tubes 2 in a common housing 3. On opposite ends the two radiant tubes 2 each have a burner 1, so that the flames produced by these burners 1 extend in opposite directions within the parallel radiant tubes 2.

On their ends the two radiant tubes 2 are each connected to an exhaust passage 5 through which the exhaust gases produced by the combustion in the burners 1 are supplied to chimneys 6.

Furthermore, each burner 1 includes a fresh air passage 8 through which the respective one of the burners 1 is supplied with fresh air for the combustion. The fresh air passage 8 is respectively connected to the fan 7 which is arranged upstream of the respective burner 1.

In FIG. 4 it can be further seen that between each exhaust passage 5 of a radiant tube 2 and the fresh air passage 8 of the adjacent radiant tube 2 an exhaust gas recirculation system 9 corresponding to the embodiment according to the FIGS. 1 to 3 is provided. Through these exhaust gas recirculation systems 9 the exhaust gas form a radiant tube 2 is supplied to the fan 7 of the second radiant tube 2 extending parallel to it.

Normally the operation of the heating device according to FIG. 4 corresponds to the operation of the heating devices according to the FIGS. 1 to 3. This results in a heating device with a high efficiency, because heat losses which are due to long exhaust passages are avoided.

A further embodiment of a heating device according to the invention is shown in FIG. 5. Differently from the above-described embodiments according to the FIGS. 1 to 4 this embodiment according to FIG. 5 includes a second fan 7 which is arranged in the exhaust passage 5 and is formed as a radial fan. The output of this fan 7 in the exhaust passage 5 is variable in dependence of the power stage of the burner 1, so that the fan 7 in the exhaust passage 5 blows a high portion of exhaust gas into the burner 1 and the downstream radiant tube 2, so far as the burner 1 is operated in the lower one of the two power stages. When the burner 1 is switched to the higher one of the two power stages, the output of the fan 7 in the exhaust passage 5 is reduced or cut off, so that the exhaust gas supplied to the fan 7 through the exhaust passage 5 can escape through the chimney 6.

A further embodiment of the heating device according to the invention is illustrated in FIG. 6. This embodiment substantially corresponds to the embodiment according to FIG. 5 or to the embodiments according to the FIGS. 2 and 3. Differently from the above-described embodiments according to the FIGS. 2, 3 and 5 the embodiment according to FIG. 6 includes an electromagnetically controlled flap, so that the volume flow regulator 11 has an electromagnet, by means of which the flap can be adjusted in dependence of the power stages of the burner 1.

Besides the embodiments of the heating device according to the invention described above and illustrated in the FIGS. 1 to 6 further embodiments are conceivable which for instance include in the volume flow regulator 11 a bypass valve which can be driven in dependence of the power stage of the burner 1. Of course, it is also possible to combine a number of the above-described control elements of the volume flow regulator 11. It turned out as particularly advantageous to combine the second fan 7 in the exhaust passage according to FIG. 5 with a further control element in the volume flow regulator 11.

The invention claimed is:

1. A heating device capable for heating by infrared radiation, comprising:

at least one radiant tube having a first and an opposing second end, the radiant tube being capable to emit said infrared radiation;

at least one fan provided for generating an excess or negative pressure inside the radiant tube;

at least one burner connected with the first end of the radiant tube and being capable for combustion of a gaseous fuel, wherein the burner is connected directly to the fan in order to be supplied with fresh air, wherein the burner is capable of producing an elongated flame and exhaust gas only inside the radiant tube in order to heat the radiant tube, and wherein the burner is operable in at least two power stages;

an exhaust gas passage being connected to the second end of the radiant tube opposite to the first end connected with the burner, the exhaust gas passage removing exhaust gas generated by the combustion of the fuel and the fresh air; and at least one exhaust gas recirculation system comprising:

at least one exhaust gas recirculation passage which allows recirculating of at least a part of the exhaust gas to the burner;

a control element for regulating, during operation of the radiant heater, the volume flow of the exhaust gas to be recirculated and the speed of the fan;

wherein the control element controls the exhaust gas recirculation system and the speed of the fan in dependence on the power stages of the burner during operation of the radiant heater in such a way that the volume flow of the recirculated exhaust gas is reduced with an increasing power stage of the burner, and the speed of the fan is increased with an increasing power stage of the burner.

2. The heating device according to claim 1, wherein the burner can be operated in a modulating fashion in power stages.

3. The heating device according to claim 1, wherein the exhaust gas recirculation system includes a volume flow regulator for the volume flow of the recirculated exhaust gas.

4. The heating device according to claim 3, wherein the volume flow regulator is formed as a bypass valve.

5. The heating device according to claim 3, wherein the volume flow regulator includes a flap and/or sliding valve which is arranged in the exhaust gas recirculation passage and which closes at a determined output of the burner.

6. The heating device according to claim 1, wherein the burner has two power stages and wherein the exhaust gas recirculation system is activated in one power stage.

7. The heating device according to claim 1, wherein the fan is arranged on an end of the radiant tube opposite the burner.

8. The heating device according to claim 1, wherein the fan is arranged with the burner on one end of the radiant tube.

9. The heating device according to claim 1, wherein the exhaust gas recirculation system includes a measuring element with which temperature, exhaust gas values, and volume flow are measured and used for the control of the exhaust gas recirculation system.

10. The heating device according to claim 3, wherein the volume flow regulator can be electrically and/or thermally controlled.

11. The heating device according to claim 3, wherein the volume flow regulator can be controlled simultaneously with an output regulator of the burner.

12. The heating device according to claim 1, wherein for the activation of the power stages the burner includes a magnetic valve which has a number of switching steps that corresponds to the number of power stages.

13. The heating device according to claim 1, wherein the switching steps of the magnetic valve can be selected through a temperature regulator.

14. A method for operating a radiant heater, the method comprising the steps of:

providing the radiant heater having at least one radiant tube, the radiant tube having a first and an opposing second end, the radiant tube being capable to emit infrared radiation, wherein at least one burner is connected with the first end of the radiant tube, wherein the burner is operable in at least two power stages, and wherein an exhaust gas passage is connected to the second end of said radiant tube opposite to the first end connected with the burner;

generating an excess or negative pressure inside the radiant tube and the burner with a fan, wherein the fan is connected directly to the burner in order to supply the burner with fresh air;

supplying fresh air to the burner by the fan via a fresh air passage;

supplying a gaseous fuel to the burner;

combusting said gaseous fuel and fresh air by use of the burner, whereby producing an elongated flame and exhaust gas only inside the radiant tube;

heating the radiant tube by the elongated flame and the heat of the exhaust gas;

emitting infrared radiation by the radiant tube;

removing the exhaust gas from the radiant tube by the exhaust gas passage;

recirculating at least a part of the exhaust gas by introducing it into the fresh air via at least one exhaust gas recirculation passage; and regulating the volume flow of the recirculated exhaust gas and the speed of the fan dependent on the power stages of the burner, during operation of the radiant heater, in such a way that that the volume flow of the recirculated exhaust gas is reduced with an increasing power stage of the burner, and the speed of the fan is increased with an increasing power stage of the burner.

15. The method according to claim 14, wherein the burner is operated in a modulating fashion in power stages.

16. The method according to claim 14, wherein through the exhaust gas recirculation system a volume flow regulator for the volume flow of the recirculated exhaust gas is controlled.

17. The method according to claim 16, wherein through the volume flow regulator the output and especially the speed of the fan is controlled.

18. The method according to claim 16, wherein through the volume flow regulator a flap and/or sliding valve is controlled which is arranged in the exhaust gas recirculation passage and which is closed at a determined output of the burner.

19. The method according to claim 14, wherein the burner is operated in two power stages and that the exhaust gas recirculation system is activated in one power stage.

20. The method according to claim 14, wherein the exhaust gases from a first radiant tube including a first burner are introduced through an exhaust gas recirculation system in an opposed second radiant tube which includes a second burner, whereas exhaust gases from the opposed second radiant tube are introduced in the first radiant tube through an exhaust gas recirculation system.

21. The method according to claim 20, wherein the exhaust gas recirculation systems are controlled in dependence of the output of the burners of the opposed radiant tubes.

22. The method according to claim 20, wherein the exhaust gas recirculation systems of the opposed radiant tubes are controlled independently of each other.

23. The method according to claim 20, wherein the exhaust gas recirculation system is controlled through a measuring element, by means of which parameters like temperature, exhaust gas values, volume flow or the like are measured.

24. The method according to claim 16, wherein the volume flow regulator is electrically and/or thermally controlled.

25. The method according to claim 16, wherein the volume flow regulator is controlled simultaneously with an output regulator of the burner.

26. The method according to claim 14, wherein the power stages of the burner are controlled through a magnetic valve which has a number of switching steps corresponding to the number of power stages.

27. The method according to claim 14, wherein the switching steps of the magnetic valve are controlled through a temperature regulator.

28. The method according to claim 14, wherein the exhaust gas is conveyed by pressure differences between the end-side end of the radiant tube and the transition zone between the burner and the radiant tube.

29. The method according to claim 14, wherein in a first, higher power stage of the burner 0 to 30% by volume of the exhaust gas are recirculated into the transition zone between the burner and the radiant tube.

30. The method according to claim 14, wherein in a second, lower power stage of the burner 20 to 60% by volume of the exhaust gas are recirculated into the transition zone between the burner and the radiant tube.

* * * * *